US011317185B2

(12) United States Patent
Imamura

(10) Patent No.: US 11,317,185 B2
(45) Date of Patent: Apr. 26, 2022

(54) EARPHONE

(71) Applicant: VIE STYLE, INC., Kanagawa (JP)

(72) Inventor: Yasuhiko Imamura, Kanagawa (JP)

(73) Assignee: VIE STYLE, INC., Kanagawa (JP)

( * ) Notice: Subject to any disclaimer, the term of this patent is extended or adjusted under 35 U.S.C. 154(b) by 21 days.

(21) Appl. No.: 16/650,336

(22) PCT Filed: Sep. 28, 2017

(86) PCT No.: PCT/JP2017/035253
§ 371 (c)(1),
(2) Date: Oct. 5, 2020

(87) PCT Pub. No.: WO2019/064438
PCT Pub. Date: Apr. 4, 2019

(65) Prior Publication Data
US 2021/0321187 A1 Oct. 14, 2021

(51) Int. Cl.
*H04R 1/00* (2006.01)
*H04R 1/10* (2006.01)
*H04R 1/34* (2006.01)

(52) U.S. Cl.
CPC ..... *H04R 1/1016* (2013.01); *H04R 1/1058* (2013.01); *H04R 1/345* (2013.01)

(58) Field of Classification Search
CPC .... H04R 1/345; H04R 1/1016; H04R 1/1058; H04R 1/1066; H04R 1/105; H04R 1/1083; H04R 2201/107; H04R 2420/07
See application file for complete search history.

(56) References Cited

U.S. PATENT DOCUMENTS 5,784,471 A * 7/1998 Bebenroth ..... H04R 25/656 381/322
2009/0232342 A1* 9/2009 Oliveira ..... H04R 1/1016 381/382
2015/0249877 A1 9/2015 Zhao et al.

FOREIGN PATENT DOCUMENTS

JP 2003-143681 A 5/2003
JP 2007-037187 A 2/2007
JP 2015-076856 A 4/2015
JP 2015-513246 A 4/2015
JP 2017-123653 A 7/2017
WO WO 2010/005039 A1 1/2020

OTHER PUBLICATIONS

International Search Report and Written Opinion for International Application No. PCT/JP2017/035253, with English translation, 12 pages, dated Nov. 7, 2017.

* cited by examiner

*Primary Examiner* — Matthew A Eason
(74) *Attorney, Agent, or Firm* — Squire Patton Boggs (US) LLP

(57) ABSTRACT

The purpose of the present invention is to provide an earphone with a better fit and with an improved sound quality. An earphone 20 is provided with: an elastic housing 21; a speaker 24 contained within the housing 21; and a nozzle 26 fixed on the housing 21. The nozzle 26 includes a sound guiding part 33 through which sounds from the speaker 24 pass and is configured such that the orientation of the sound guiding part 33 relative to the housing 21 can be adjusted by elastic deformation of the housing 21.

6 Claims, 10 Drawing Sheets

EARPHONE

TECHNICAL FIELD

The present invention relates to an earphone.

BACKGROUND ART

Generally, as earphones, there have been known an inner ear type earphone (for example, Apple AirPods®) worn in a wearer's auricle and a canal type earphone in which an elastic eartip is pushed into a wearer's ear canal (for example, see Patent Document 1).

CITATION LIST

Patent Document

Patent Document 1: Japanese Patent Application Laid-Open No. 2007-37187

SUMMARY

Technical Problem

Both types have advantages and disadvantages. For example, the former type is able to be worn lightly by placing a hard housing on a wearer's ear concha. The size and shape of the ear concha, however, depend on the wearer and therefore it is sometimes difficult to obtain a fit with an ear. Low fit may lead to low sound insulation or it may cause an earphone to fall off from an ear during strenuous exercise.

On the other hand, the latter type provides high fit with an ear, because the eartip is able to deform elastically according to the shape of the wearer's ear canal. The angle of the ear canal and the position of an eardrum, however, also depend on the wearer. Therefore, sound from the speaker is not always directly transmitted, depending on the orientation of the nozzle through which the sound from the speaker passes when the eartip is pushed into the ear canal, by which high-quality sound cannot be provided.

Moreover, a completely wireless earphone, which is recently put into practical use, includes all of a substrate, a battery, and an antenna within a housing and therefore has a large exterior, by which the completely wireless earphone is further required to solve a problem such as an interference with an outer ear or a problem such that sound from a speaker is not directly transmitted.

Therefore, it is an object of the present invention to provide an earphone with a better fit and with an improved sound quality.

Solution to Problem

An earphone according to an aspect of the present invention includes an elastic housing, a speaker contained within the housing, and a nozzle fixed on the housing, the nozzle including a sound guiding part, through which sounds from the speaker passes, wherein the nozzle is configured such that the orientation of the sound guiding part relative to the housing can be adjusted by elastic deformation of the housing.

Advantageous Effects of Invention

The fit of the earphone and the sound quality thereof is able to be improved.

DESCRIPTION OF EMBODIMENTS

Referring to the accompanying drawings, the structure of a human ear will be described and thereafter an earphone according to a preferred embodiment of the present invention will be described.

Figure 1:
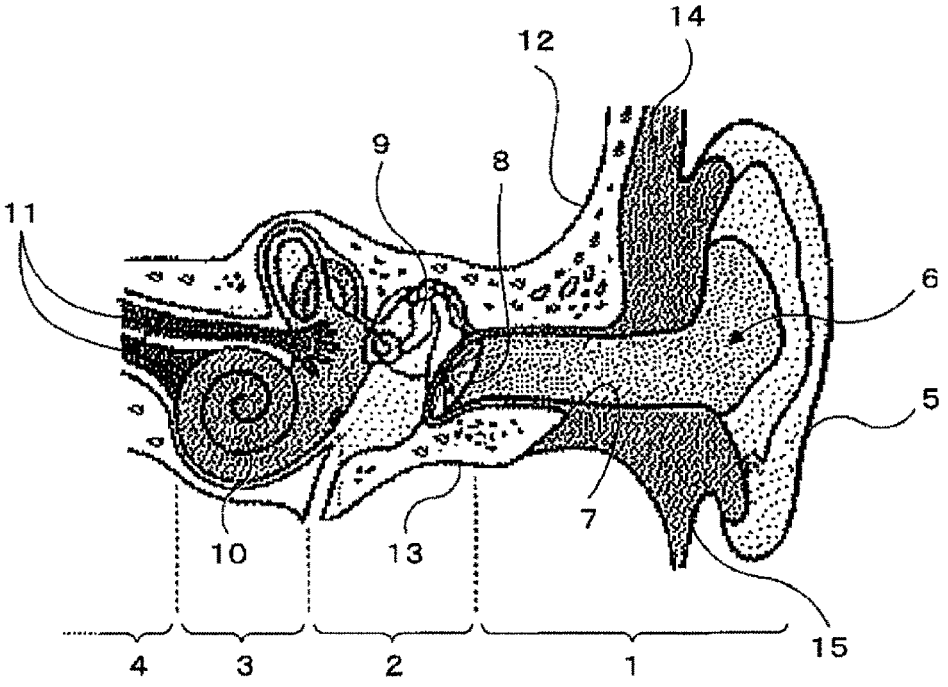
FIG. 1 is a cross section of a human ear.
Figure 2A:
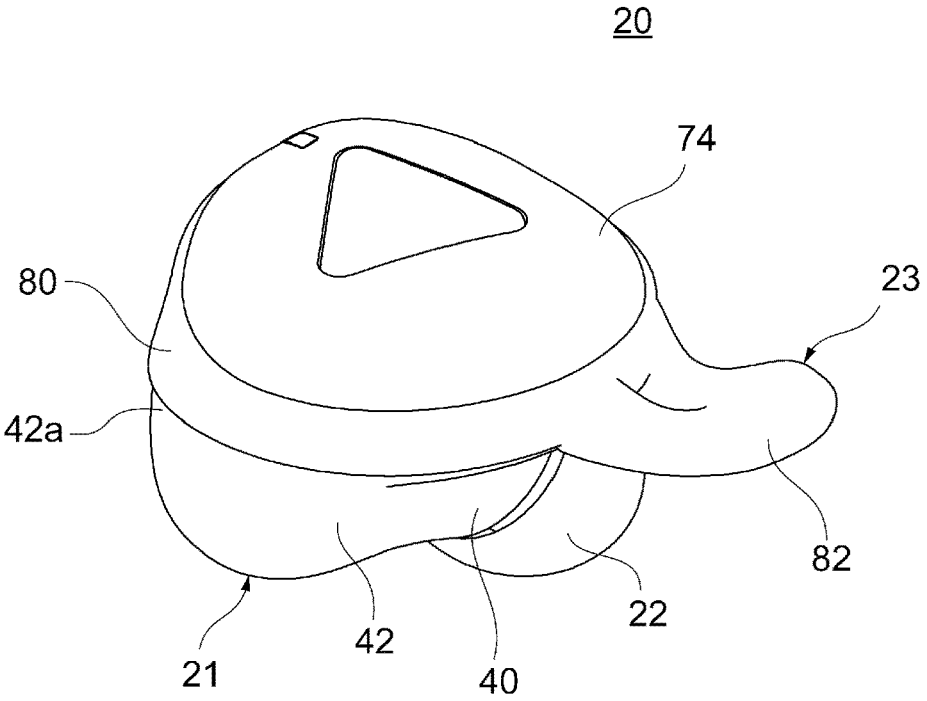
FIG. 2A is a perspective view of an earphone according to an embodiment, viewed from one side.
Figure 2B:
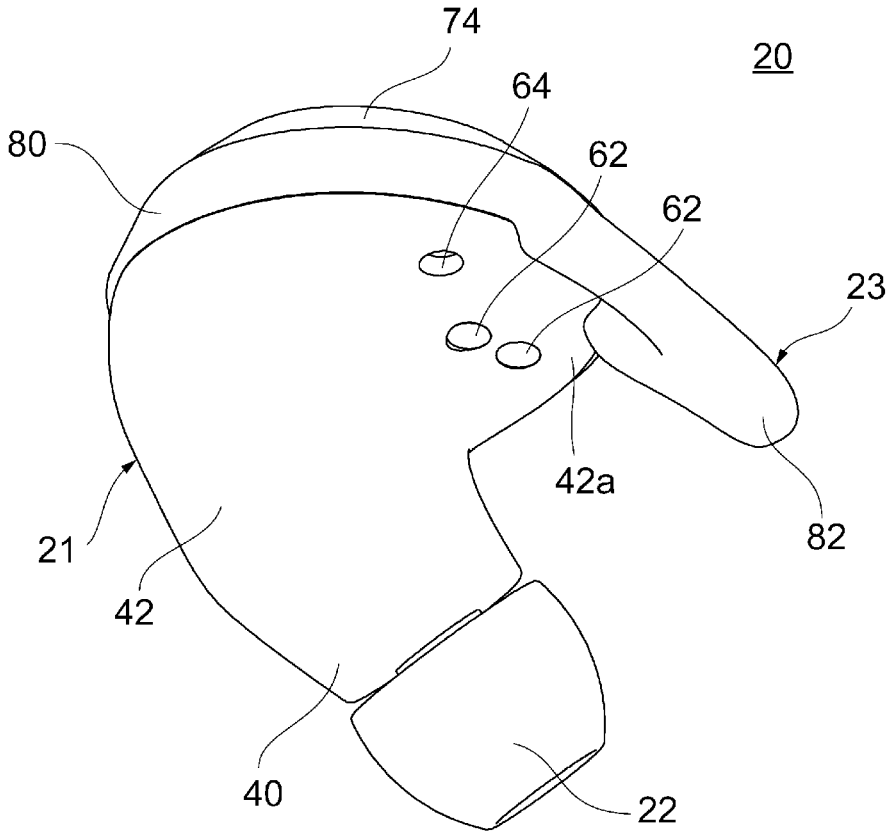
FIG. 2B is a perspective view of an earphone of FIG. 2A, viewed from another side.
Figure 3A:
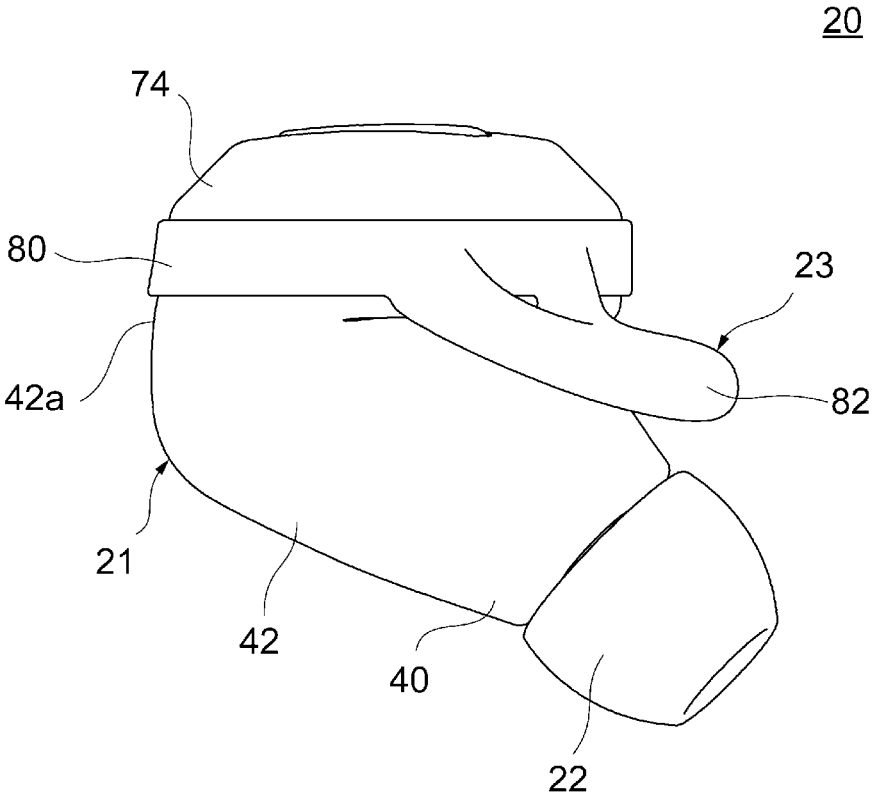
FIG. 3A is a front view of the earphone of FIG. 2A.
Figure 3B:
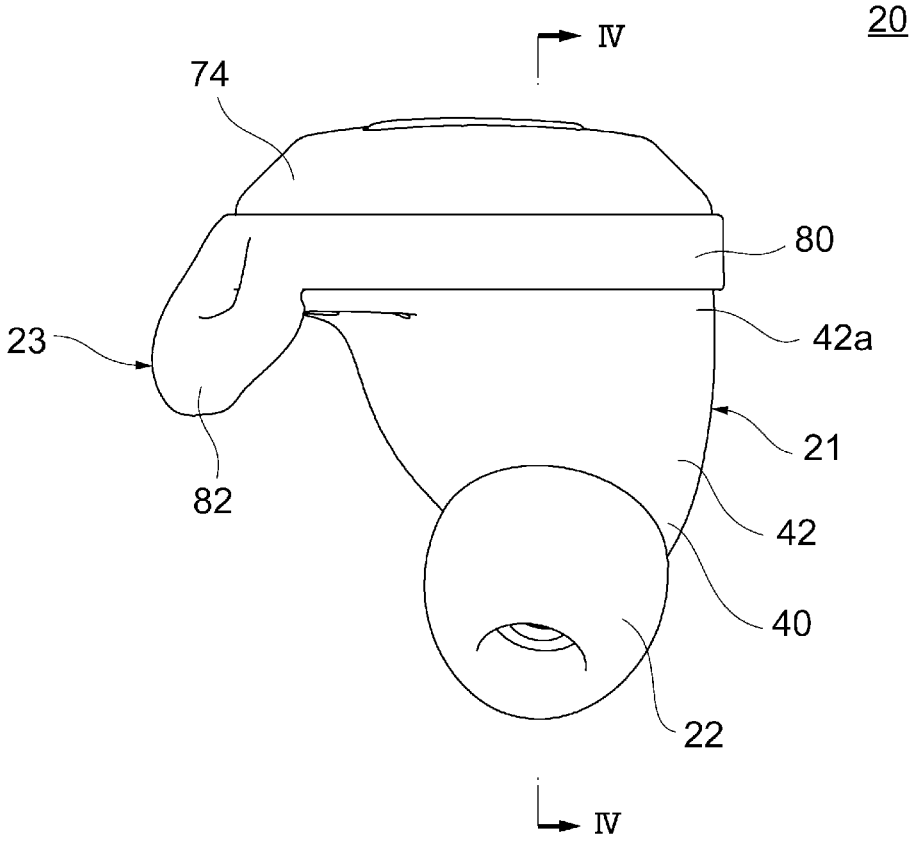
FIG. 3B is a right side view of the earphone of FIG. 2A.
Figure 3C:
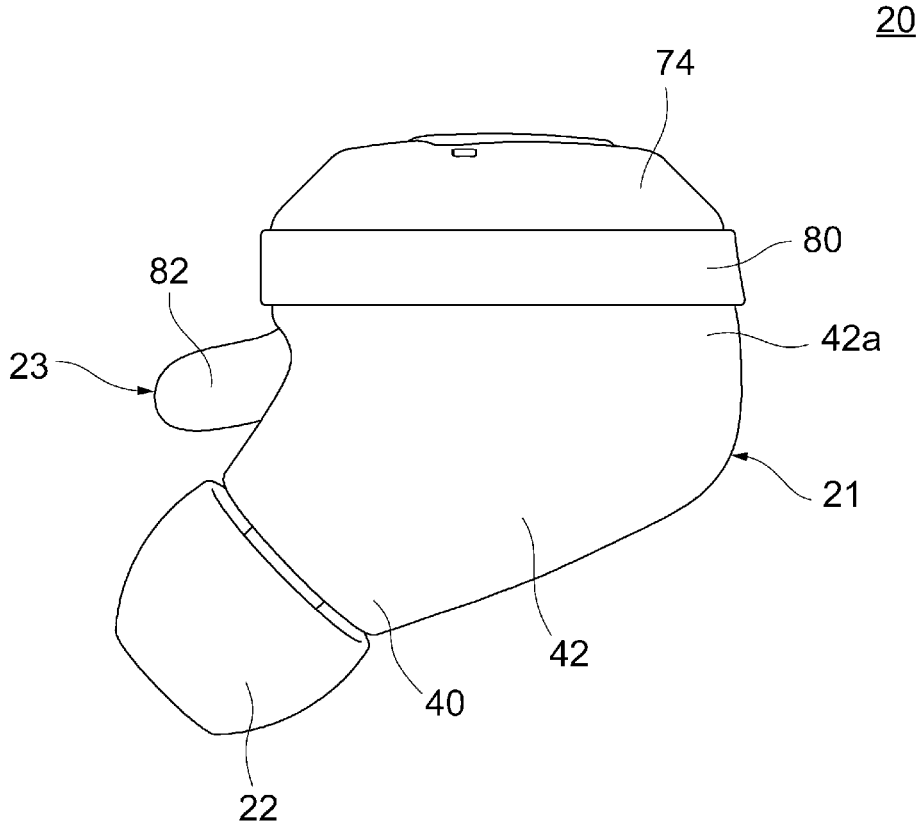
FIG. 3C is a rear view of the earphone of FIG. 2A.

As illustrated in FIG. 1, a human ear is divided into an outer ear 1, a middle ear 2, an inner ear 3, and an auditory nerve 4 from the outside toward the inside of the head. The outer ear 1 includes an earlobe 5, an ear concha 6, and an ear canal 7 and the middle ear 2 includes an eardrum 8 and an auditory ossicle 9 in the deepest part of the ear canal 7. The inner ear 3 includes a cochlea 10 and the auditory nerve 4 includes a cochlear nerve 11. The outer ear 1, the middle ear 2, the inner ear 3, and the auditory nerve 4 are protected by a skull 12, 13, which is covered with skins 14, 15. In the human ear part having the above structure, sounds from the outside world pass through the ear canal 7 and reach the eardrum 8 to vibrate the eardrum 8. The vibration is amplified in the cochlea 10 and then transmitted to a brain, which is not illustrated, via cochlear nerves 11 connected to the cochlea 10, by which the vibration is perceived as sound.

Figure 4:
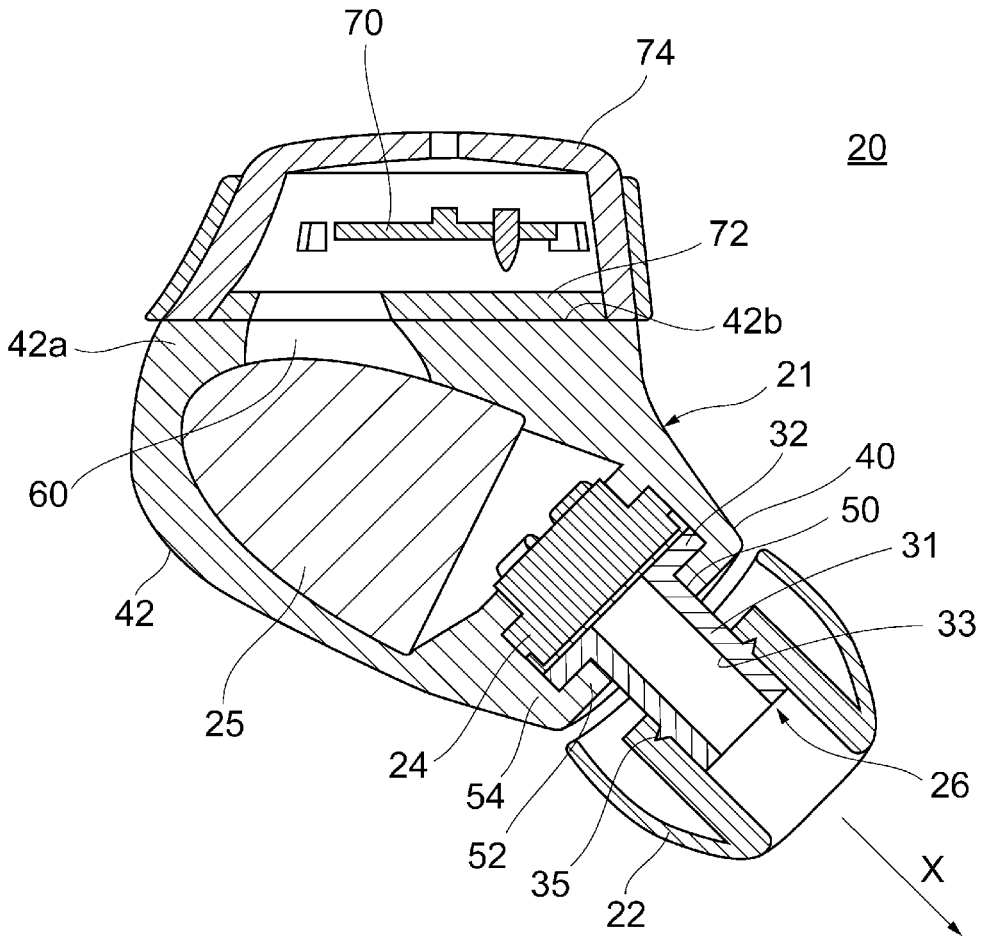
FIG. 4 is a schematic sectional view taken along line IV-IV of FIG. 3B.

As illustrated in FIGS. 2A to 3C, the earphone 20 includes a housing 21 an eartip 22, and a wing 23. As illustrated in FIG. 4, the housing 21 is a member with a cavity inside, where the cavity portion contains a speaker 24 and a battery 25. Moreover, as illustrated in FIG. 4, the eartip 22 is attached to a nozzle 26 that protrudes from the housing 21.

As illustrated in FIG. 4, the nozzle 26 has a shape such that a flange is formed at an end of a tubular member. Specifically, the nozzle 26 has a tubular part (a first portion) 31 placed in the wearer's ear canal 7 when wearing the earphone 20, a flange part (a second portion) 32 fixed on the housing 21, and a sound guiding part 33 that connects the inside of the tubular part 31 and the inside of the flange part 32 to each other in a first direction X. The tubular part 31 extends in the first direction X so as to protrude from the housing 21, with a locking projection 35 for detachably locking the eartip 22 formed on the tip side of the tubular part 31. The flange part 32 is formed on the base end side of the tubular part 31. The sound guiding part 33 functions as a passage through which sounds from the speaker 24 pass. The nozzle 26 is formed as a rigid body. As long as having these characteristics, the material of the nozzle 26 are not limited. As an example, however, hard ABS resin may be used as the material.

As illustrated in FIG. 4, the housing 21 includes a nozzle fixing part 40, to which the flange part 32 of the nozzle 26 is fixed, and an extended part 42, which extends to the opposite side of the nozzle 26 from the nozzle fixing part 40 and is extended more than the nozzle fixing part 40. The nozzle fixing part 40 has an opening 50 into which the tubular part 31 of the nozzle 26 is inserted, a regulating part 52, which abuts on the flange part 32 of the nozzle 26 to regulate falling-off of the nozzle 26 from the opening 50, and a surrounding part 54, which is a connecting portion between the regulating part 52 and the extended part 42 and which encloses the flange part 32. The fixing of the nozzle 26 in the nozzle fixing part 40 is able to be performed, for example, by fitting the flange part 32 into the surrounding part 54 or by bonding the flange part 32 to the regulating part 52 or to the surrounding part 54.

As illustrated in FIGS. 2A to 4, the extended part 42 is formed so as to extend gradually as it is away from the nozzle fixing part 40, as a whole. As illustrated in FIG. 4, the extended part 42 contains the speaker 24 inside on the nozzle 26 side and contains the battery 25 in an area expanded more than the portion in which the speaker 24 is contained. Moreover, the extended part 42 has an opening 60 for wiring in an end 42*a* at which the extension ends. The speaker 24 and the battery 25 are hard-wired to a substrate 70 through the opening 60. Furthermore, the opening 60 is also used to put the speaker 24 and the battery 25 into the housing 21 when the earphone 20 is assembled. In the end 42*a* of the extended part 42, openings 62, 62 for charging and an opening 64 for a microphone are formed in positions different from the position of the opening 60, as illustrated in FIG. 2B. When the earphone 20 is not worn, the battery 25 is charged through the openings 62, 62 for charging.

In addition, the extended part 42 has a flat end face 42*b* where the extension ends, as illustrated in FIG. 4. A plate 72 with the substrate 70 fixed thereto is placed on the end face 42*b* and a cover 74 covering the substrate 70 and the plate 72 is attached to the end face 42*b*. The substrate 70 is provided with an antenna for wireless communication. The antenna is compatible with wireless communication standards such as those of Bluetooth®, for example. Therefore, the earphone 20 is configured as a wireless earphone and wirelessly connected to a mobile device, a laptop computer, and other devices to communicate with these devices by sending or receiving sound data.

Figure 5A:
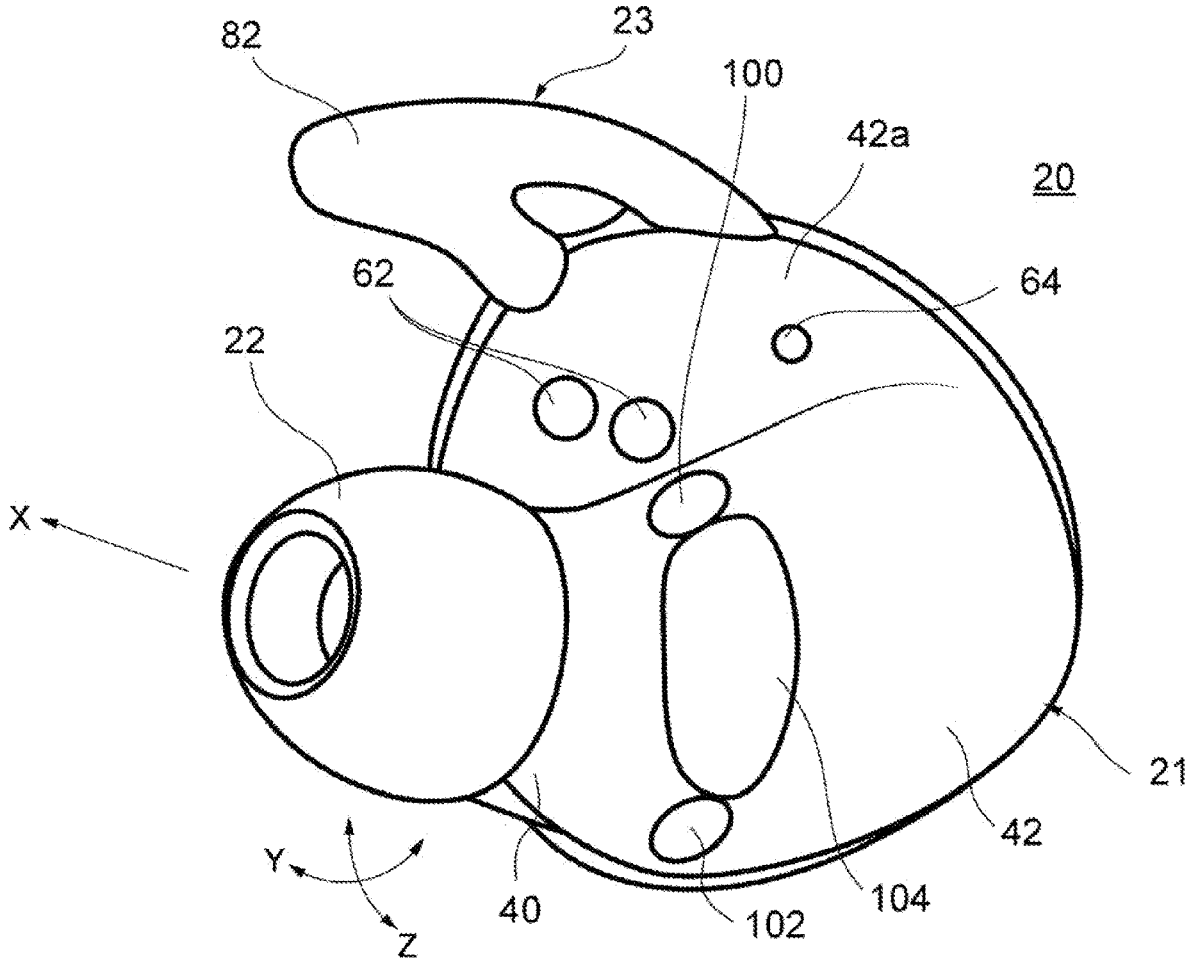
FIG. 5A is a diagram of the earphone of FIG. 2A, viewed from the bottom side, illustrating a state before adjusting the orientation of a nozzle.
Figure 5B:
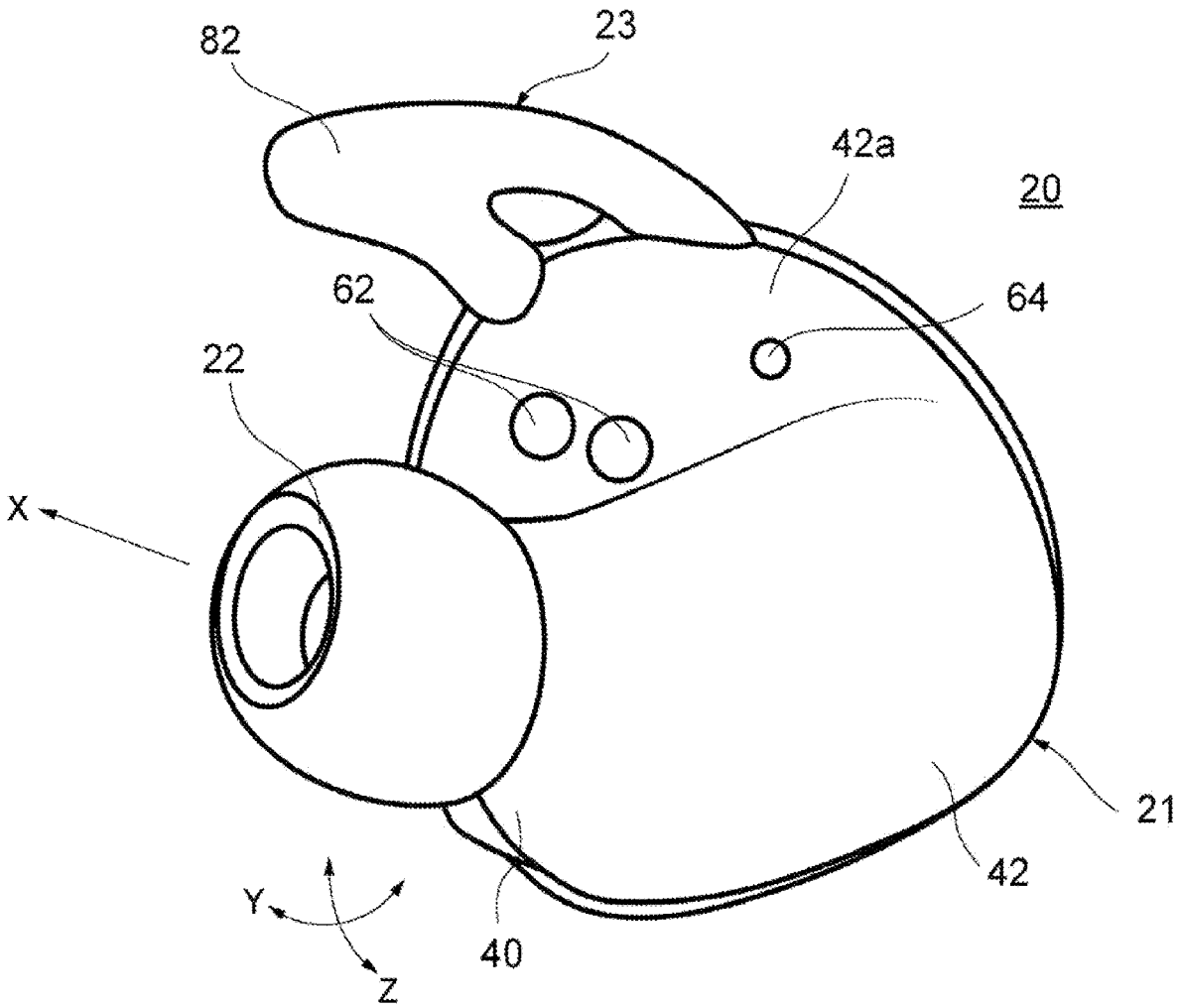
FIG. 5B is a diagram of the earphone of FIG. 2A, viewed from the bottom side, illustrating a state after adjusting the orientation of the nozzle.

The housing 21 configured as described above is elastic and flexible. As long as the housing 21 has these characteristics, the material that forms the housing 21 is not limited. As an example, however, soft, low-resilient, and strong material such as, for example, silicon rubber may be used. The housing 21 is able to be elastically deformed by human force. Due to the elastic deformation of the housing 21, the nozzle 26 is configured such that the orientation of the extending direction (the first direction X) of the nozzle 26, in other words, the orientation of the sound guiding part 33 relative to the housing 21 can be adjusted. For example, the housing 21 is elastically deformed around the area near the boundary between the nozzle fixing part 40 and the extended part 42 in the housing 21 in a state illustrated in FIG. 5A, by which the portion on the nozzle 26 side (the eartip 22 side) is able to be moved in the horizontal direction Y and in the vertical direction Z. FIG. 5B illustrates a state where the portion on the nozzle 26 side (the eartip 22 side) has been slightly moved upward from the state illustrated in FIG. 5A. As a result, the orientation of the first direction X of the nozzle 26 slightly differs between FIG. 5A and FIG. 5B.

Figure 6A:
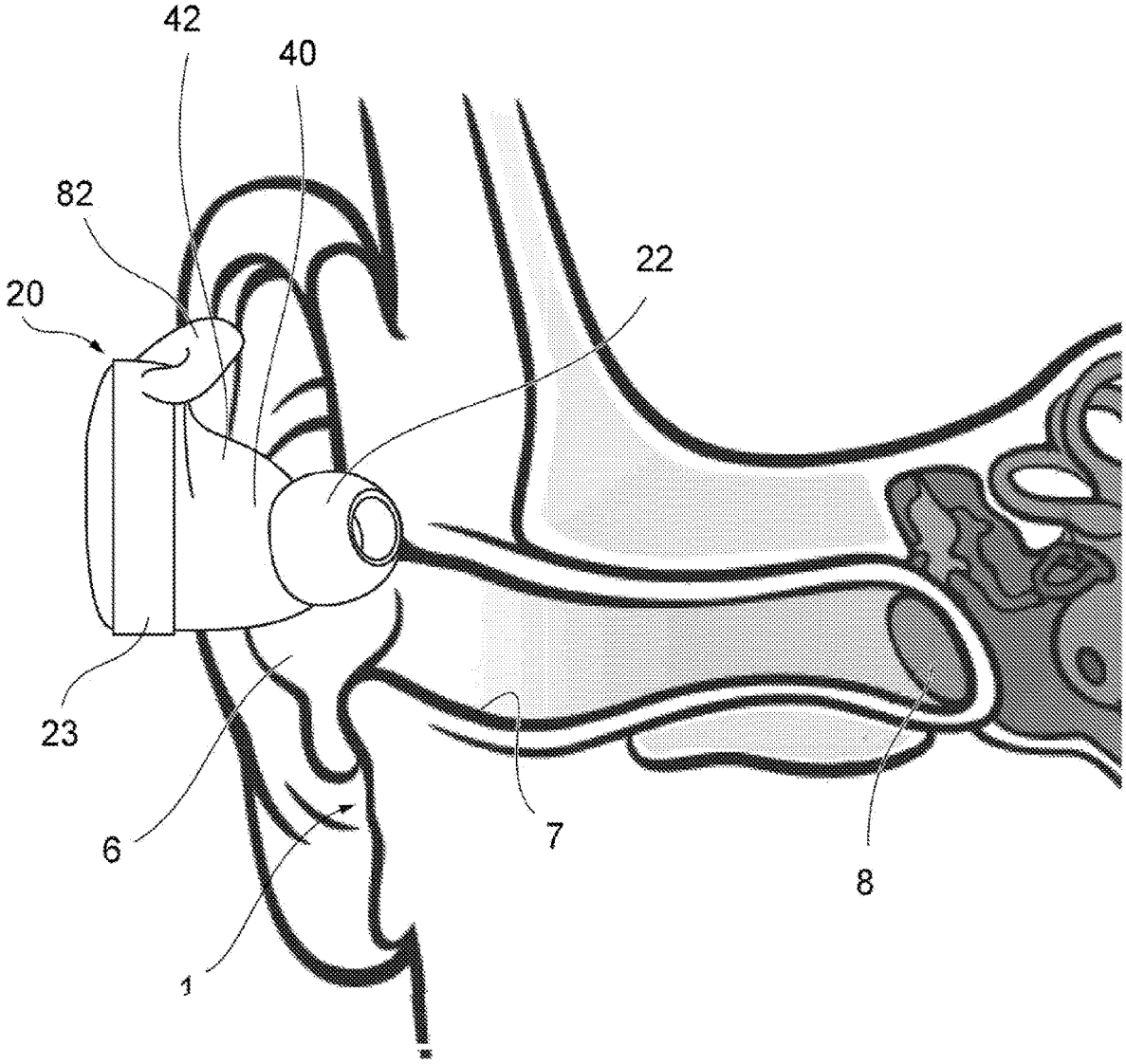
FIG. 6A is a diagram of the earphone of FIG. 2A illustrating a state before a wearer wears the earphone.
Figure 6B:
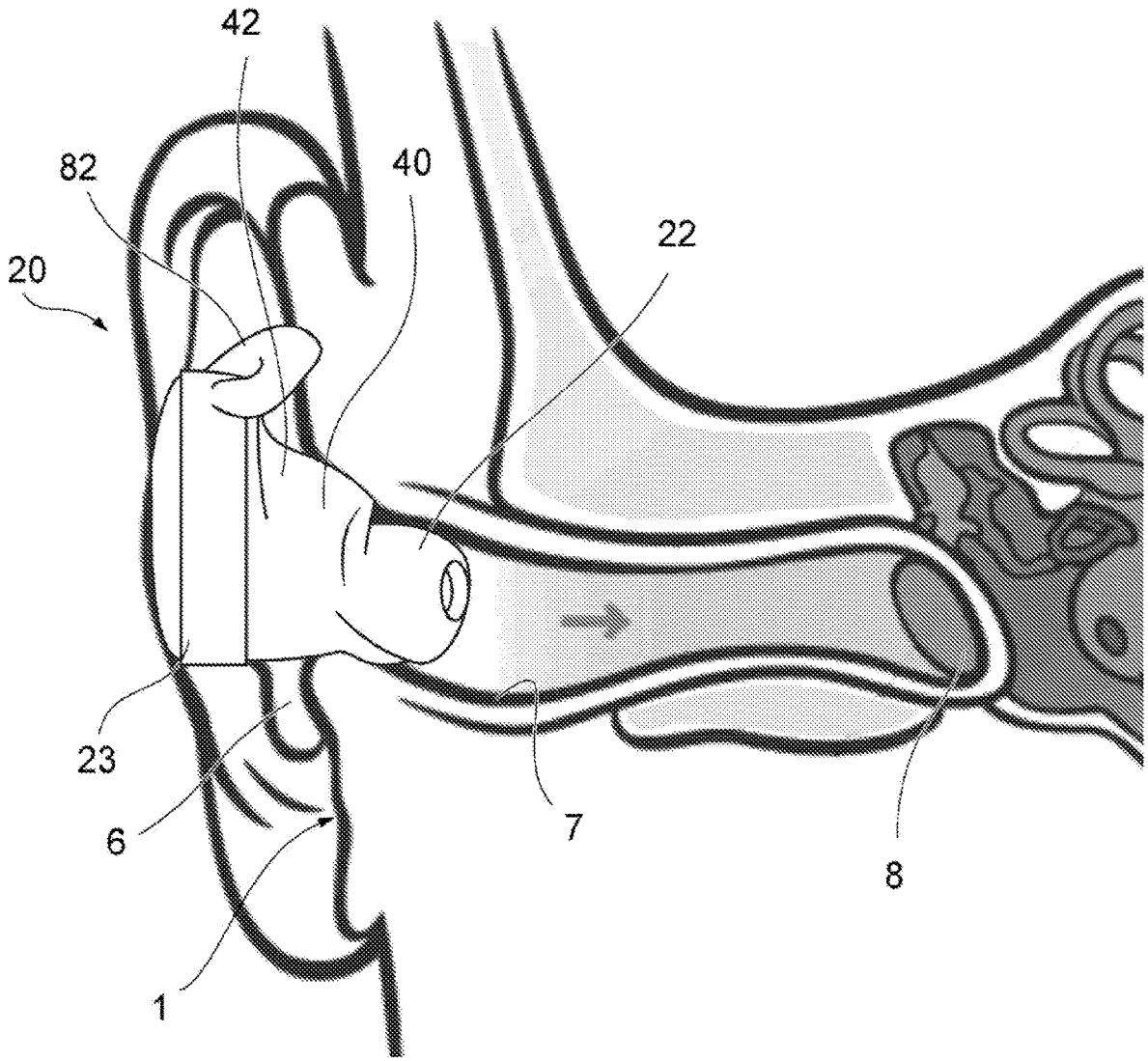
FIG. 6B is a diagram of the earphone of FIG. 2A illustrating a state after the wearer wears the earphone.

As illustrated in FIGS. 6A and 6B, the housing 21 comes in contact with the outer ear 1 with the housing 21 placed on the wearer's ear concha 6 when the wearer wears the earphone 20. Specifically, an outer surface of the extended part 42 of the housing 21 or an outer surface of the nozzle fixing part 40 of the housing 21 is placed on the ear concha 6, by which the housing 21 comes in contact with the outer ear 1. For example, the upper and lower regions 100 and 102 of the extended part 42 illustrated in FIG. 5A come in contact with the outer ear 1, first, when the wearer wears the earphone 20, by which the extended part 42 deforms to dent by receiving the contact pressure. Thereafter, a middle region 104 between the regions 100 and 102 of the extended part 42 comes in contact with the outer ear 1 to fit the outer ear 1. This working is mainly provided by the flexibility of the housing 21. When the wearer wears the earphone 20, the eartip 22 is positioned in the ear canal 7 and comes in close contact with the ear canal 7 over the entire circumference thereof. In the state where the wearer wears the earphone 20, the wearer is able to deform the housing 21 elastically so as to adjust the orientation (the direction in which output sound is oriented) of the nozzle 26.

Again, referring to FIGS. 2A to 3B, the wing 23 includes a circular mounting part 80, which is fit into the peripheral surface of the cover 74 and an ear retaining part 82, which protrudes from the mounting part 80. The ear retaining part 82 protrudes in a substantially U-shape toward the eartip 22 side from the mounting part 80. As illustrated in FIG. 6B, the ear retaining part 82 mainly works as a hook on the wearer's outer ear 1 when the wearer wears the earphone 20 and supports the wearer to prevent the earphone 20 from falling off from the wearer's ear concha 6. The wing 23 may be formed of elastic and flexible material similarly to the housing 21.

According to the earphone 20 of the above-described embodiment, the elastic housing 21 is able to deform to fit the size and shape of the ear concha 6 when the wearer wears the earphone, thereby providing a better fit to the ear. Moreover, the housing 21 that comes in contact with the outer ear 1 when the wearer wears the earphone is flexible, thereby providing less stress on the wear's skin even over extended periods of use than in the case of a hard housing. In addition, the elastic deformation of the housing 21 by the wearer at the time of wearing the earphone enables adjustment of the orientation of the sound guiding part 33 relative to the housing 21, namely the angle of the speaker 24, accordingly. Thus, even in the case where the angle of the ear canal 7 or the position of the eardrum 8 depends on the wearer, working on the housing 21 at the time of wearing the earphone enables adjustment such that sounds from the speaker 24 can be directly transmitted to the eardrum 8. This enables improvement of the sound quality.

Particularly, not only eartip 22 but also all exterior portions (the housing 21, the wing 23) touching the skin of the earphone 20 may be formed of elastic and flexible material. Therefore, even in the case where the shape or the like of an ear varies among different individuals, fitting the earphone 20 to an ear provides good wearing feeling and high sound insulation and enables the earphone 20 to be less likely to fall off. Moreover, sounds from the speaker 24 can be adjusted so as to be directly transmitted to the eardrum 8, thus, for example, improving a noise cancelling performance of cutting off ambient sounds and preventing loss of bass tones, thereby achieving high sound quality.

Furthermore, the housing 21 is provided with the extended part 42 and the extended part 42 can be used to have the speaker 24 and the battery 25 contained in the housing 21. In addition, the nozzle 26 is configured to be a rigid body, thereby preventing the deformation of the nozzle 26. This prevents reduction in sound propagation power caused by deformation of the nozzle 26.

The aforementioned embodiments are presented for facilitating understanding of the present invention and do not intend to limit the interpretation thereof. The respective elements of the embodiments, and positions, materials, conditions, shapes, sizes, and the like thereof are not limited to the examples and may be appropriately modified.

REFERENCE SIGNS LIST

1 outer ear
2 middle ear
3 inner ear
4 auditory nerve
6 ear concha
7 ear canal
8 eardrum
9 auditory ossicle
10 cochlea
11 cochlear nerve
12 skull
13 skull
14 skin
15 skin
20 earphone
21 housing
22 eartip
23 wing
24 speaker
25 battery
26 nozzle
31 tubular part (first portion)
32 flange part (second portion)
33 sound guiding part
35 locking projection
40 nozzle fixing part
42 extended part
42*a* end
42*b* end face
50 opening
52 regulating part
54 surrounding part
60, 62, 64 opening
70 substrate
72 plate
74 cover
80 mounting part
82 ear retaining part
100 region
102 region
104 middle region
X first direction

What is claimed is:

1. An earphone comprising:
an elastic housing;
a speaker contained within the housing; and
a nozzle fixed on the housing, having a sound guiding part through which sounds from the speaker pass,
wherein the nozzle is configured such that the orientation of the sound guiding part relative to the housing and an angle of the speaker can be adjusted by elastic deformation of the housing,
and wherein the speaker is contained within an end of a nozzle side of the housing, and wherein at least one part of the nozzle side is positioned on a wearer's ear canal when the wearer wears the earphone.

2. The earphone according to claim 1, wherein the nozzle includes a first part which is positioned on the wearer's ear canal and a second part which is fixed on the housing,
and wherein the housing includes a nozzle fixing part with the second portion of the nozzle fixed and an extended part that extends to the opposite side of the nozzle from the nozzle fixing part and is extended more than the nozzle fixing part.

3. The earphone according to claim 1, wherein a central axis of the speaker is approximately the same as a central axis of the sound guiding part when the wearer wears the earphone.

4. The earphone according to claim 2, wherein a battery is also contained within the extended part.

5. The earphone according to claim 2, wherein:
the nozzle is a rigid body; and
the first portion of the nozzle is configured such that an eartip is attachable thereto.

6. The earphone according to claim 2, wherein:
the housing comes in contact with an outer ear of the wearer with the housing placed on a wearer's ear concha when the wearer wears the earphone;
and
the sound guiding part connects the inside of the first portion and the inside of the second portion.

* * * * *